US012258528B1

(12) United States Patent
Saty et al.

(10) Patent No.: US 12,258,528 B1
(45) Date of Patent: Mar. 25, 2025

(54) METHOD OF PRODUCING DIESEL FROM MUNICIPAL SOLID WASTE AND TIRE WASTE

(71) Applicants: Patrick E. Saty, Hudson, FL (US); John Ponchock, Stuart, FL (US); Michael James Lent, Odenton, MD (US); Gary Martin De Laurentiis, Tuguegarao (PH)

(72) Inventors: Patrick E. Saty, Hudson, FL (US); John Ponchock, Stuart, FL (US); Michael James Lent, Odenton, MD (US); Gary Martin De Laurentiis, Tuguegarao (PH)

( * ) Notice: Subject to any disclaimer, the term of this patent is extended or adjusted under 35 U.S.C. 154(b) by 0 days.

(21) Appl. No.: 18/322,713

(22) Filed: May 24, 2023

Related U.S. Application Data

(60) Provisional application No. 63/269,855, filed on Mar. 24, 2022.

(51) Int. Cl.
*C10L 1/08* (2006.01)

(52) U.S. Cl.
CPC ..... *C10L 1/08* (2013.01); *C10L 2200/0446* (2013.01)

(58) Field of Classification Search
CPC ..... C10L 1/08; C10L 2200/0446
USPC ..... 585/241, 242
See application file for complete search history.

(56) References Cited

U.S. PATENT DOCUMENTS

| | | | |
|---|---|---|---|
| 5,972,057 | A | 10/1999 | Hayafuji et al. |
| 7,578,927 | B2 | 8/2009 | Marker et al. |
| 7,771,699 | B2 | 8/2010 | Adams et al. |
| 8,034,132 | B2 | 10/2011 | Lee et al. |
| 8,420,875 | B1 | 4/2013 | Mackay et al. |
| 8,877,992 | B2 | 11/2014 | Appel et al. |
| 8,940,949 | B2 | 1/2015 | Miller |
| 9,206,453 | B2 | 12/2015 | Medoff et al. |
| 9,617,487 | B2 | 4/2017 | Zhu et al. |
| 9,834,728 | B2 | 12/2017 | Fleckner et al. |
| 10,626,340 | B2 | 4/2020 | Bai |
| 10,640,719 | B2 | 5/2020 | Freel et al. |
| 2009/0298152 | A1 | 12/2009 | Danzik |
| 2015/0031097 | A1 | 1/2015 | Rethore et al. |
| 2015/0210927 | A1 | 7/2015 | Hall |
| 2016/0200982 | A1 | 7/2016 | Doucet et al. |
| 2016/0244795 | A1 | 8/2016 | Medoff et al. |

(Continued)

*Primary Examiner* — Prem C Singh
*Assistant Examiner* — Francis C Campanell
(74) *Attorney, Agent, or Firm* — Dunlap Bennett & Ludwig, PLLC

(57) ABSTRACT

A method of producing diesel from municipal solid waste (MSW and Tire Waste) without Fischer-Tropsch synthesis, the method includes sorting waste feedstock into conforming waste capable of being converted into hydrogen-rich gas. The conforming waste is then conditioned into a specific recipe of moisture, cellulose, and/or hydrocarbons, resulting in sized fluff. Upon testing and meeting a standard for elemental composition, the fluff is then pelletized to form a very dense, high-BTU-rich, consistent solid fuel feedstock. The solid fuel pellets are then processed thermally in a high-temperature pyrolysis system which converts the solid fuel into a hydrogen-rich fuel gas. The fuel gas is reconstituted, converting it into a liquid ULSD fuel. The liquid fuel is then further analyzed and upgraded into fully compliant renewable diesel fuel and other valuable byproducts.

7 Claims, 1 Drawing Sheet

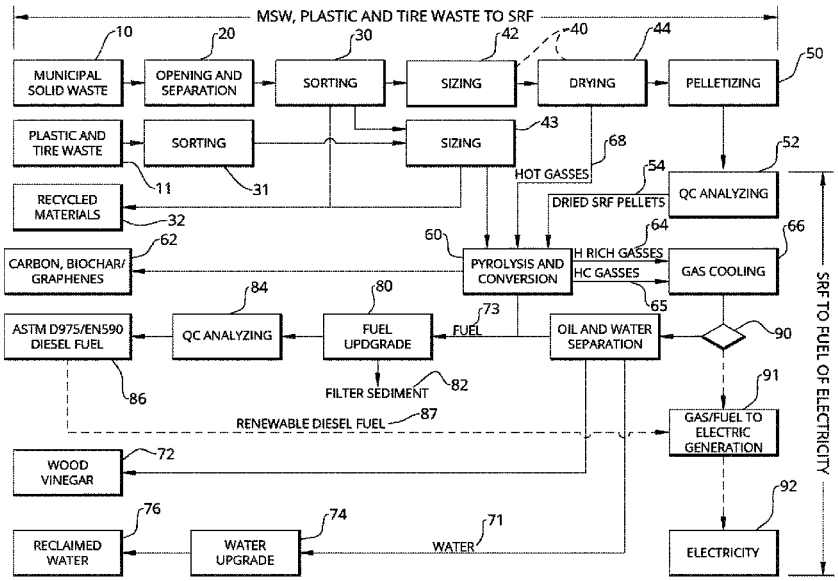

(56) References Cited

U.S. PATENT DOCUMENTS

| | | | | |
|---|---|---|---|---|
| 2020/0109336 | A1 | 4/2020 | Timko et al. | |
| 2021/0122980 | A1 | 4/2021 | Bauer et al. | |
| 2021/0220881 | A1 | 7/2021 | Kirkendoll et al. | |
| 2021/0284924 | A1* | 9/2021 | Chandran | C10K 1/007 |
| 2021/0332301 | A1 | 10/2021 | Major et al. | |
| 2023/0052296 | A1* | 2/2023 | Harper | C10G 1/02 |

* cited by examiner

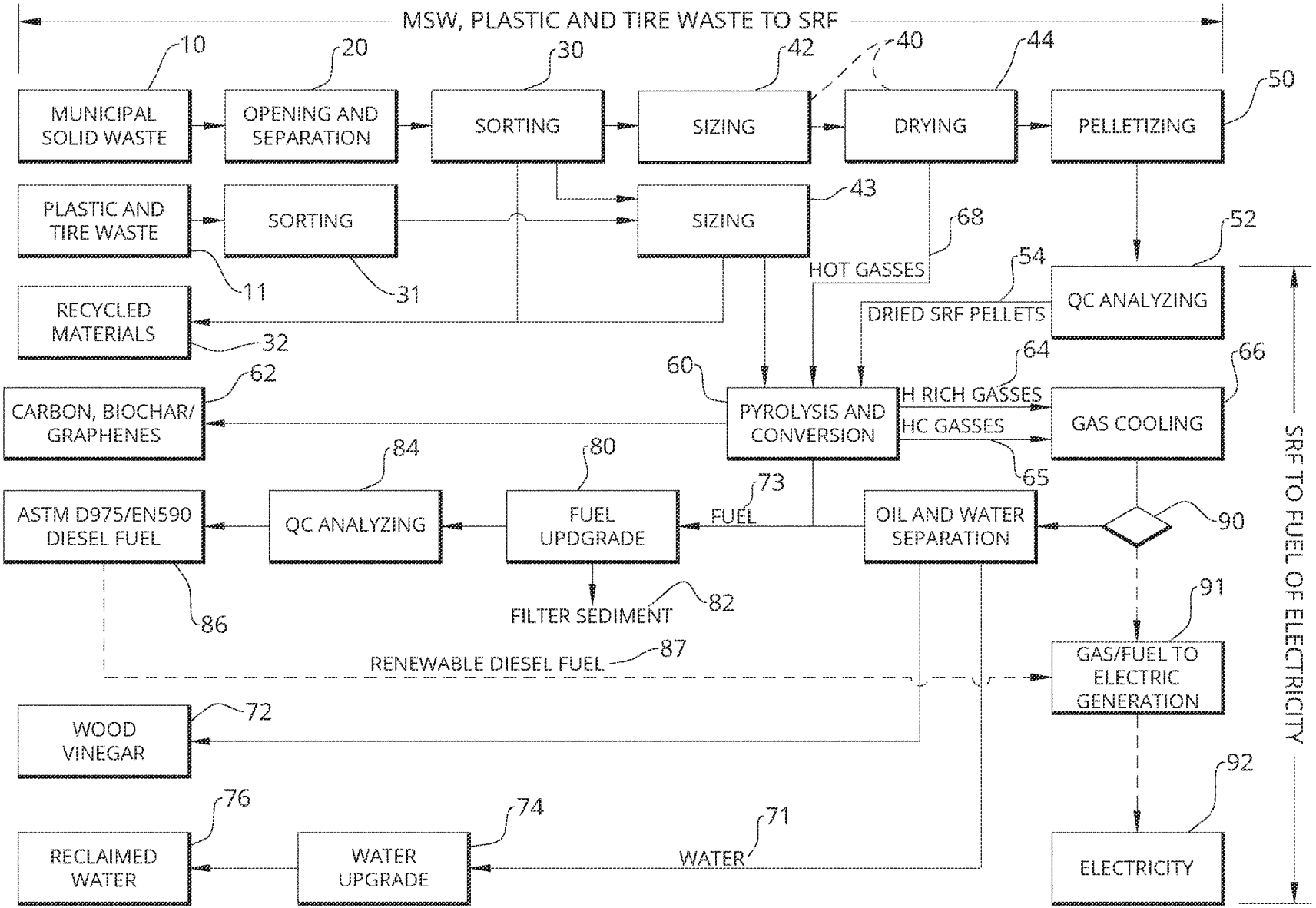
MSW, PLASTIC AND TIRE WASTE TO SRF
SRF TO FUEL OF ELECTRICITY
MUNICIPAL SOLID WASTE
10
OPENING AND SEPARATION
20
SORTING
30
SIZING
42
DRYING
44
PELLETIZING
50
PLASTIC AND TIRE WASTE
11
SORTING
31
SIZING
43
HOT GASSES
68
RECYCLED MATERIALS
32
DRIED SRF PELLETS
54
QC ANALYZING
52
CARBON, BIOCHAR/ GRAPHENES
62
PYROLYSIS AND CONVERSION
60
H RICH GASSES
64
HC GASSES
65
GAS COOLING
66
FUEL
73
OIL AND WATER SEPARATION
90
FUEL UPDGRADE
80
QC ANALYZING
84
ASTM D975/EN590 DIESEL FUEL
86
FILTER SEDIMENT
82
RENEWABLE DIESEL FUEL
87
WOOD VINEGAR
72
GAS/FUEL TO ELECTRIC GENERATION
91
ELECTRICITY
92
WATER
71
WATER UPGRADE
74
RECLAIMED WATER
76

METHOD OF PRODUCING DIESEL FROM MUNICIPAL SOLID WASTE AND TIRE WASTE

CROSS-REFERENCE TO RELATED APPLICATION

This application claims the benefit of priority of U.S. provisional application No. 63/269,855, filed Mar. 24, 2022, the contents of which are herein incorporated by reference.

BACKGROUND OF THE INVENTION

The present invention relates to producing diesel and, more particularly, to a method of producing renewable diesel from municipal solid waste.

Diesel fuel is refined from fossil crude oil which is a limited fossil resource. Additionally, the refinement and use of fossil diesel generates a net detrimental global carbon dioxide equivalent (CO2e) impact. Renewable resources such as biomass and municipal solid waste (MSW and tire waste) derived from plants and animals have their own net detrimental environmental impact.

There are only a few other processing systems in the world that can produce, on a commercial scale, renewable ultra-low sulfur diesel (ULSD) from solid fuel. A few produce USLD liquid fuel from wood byproducts. Fewer still can produce USLD from MSW and tire waste. Other than the applicant's system, no other system can produce renewable, fully compliant USLD from MSW pellets tire waste without utilizing a Fischer-Tropsch "catalyst" process backend system.

Nearly all liquid diesel (and other petroleum products) is produced from fossil crude oil. Only a few systems in the world today can produce ULSD from a combination of renewable solid waste cellulous, biogenics, and/or hydrocarbons (MSW and tire waste). None of these processing systems can produce a consistent engineered pelletized MSW and tire waste feedstock that can be converted into liquid ULSD fuel without using Fischer-Tropsch technology. The Fisher-Tropsch process has many drawbacks including high gasification costs and high CO2 emissions. In addition, the Fischer-Tropsch conversion technology is very expensive to install and operate. It uses a catalyst to achieve its fuel conversion, which is expensive. Moreover, the catalyst, which is poisoned easily, must be replaced regularly.

As can be seen, there is a need for a method of producing liquid diesel from renewable sources without the Fisher-Tropsch process.

SUMMARY OF THE INVENTION

In one aspect of the present invention, a method of producing diesel from municipal solid waste without Fischer-Tropsch synthesis includes the following steps: feeding a municipal solid waste stream comprised non-conforming material and conforming material to a sorting zone wherein it is converted to a conforming feedstock by removing at least a portion of the non-conforming material; homogenizing at least a portion of the conforming feedstock by way of a conditioning zone configured to size and dry said portion of the conforming feedstock into a fluff having a predetermine moisture content and a predetermined ratio of a biogenic waste fraction to a hydrocarbon waste fraction; pelletizing the fluff to a plurality of pellets having a predetermined size; gasifying the plurality of pellets into a hydrogen-rich gas; and liquifying the gas to diesel.

In another aspect of the present invention, the method of producing diesel from municipal solid waste without Fischer-Tropsch synthesis further includes the following: wherein the predetermined moisture content is approximately 10% by weight, and wherein the predetermined ratio of the biogenic waste fraction to the hydrocarbon waste fraction is between 19:1 to 3:1, wherein the hydrogen-rich gas has a gross heating value of approximately one thousand British thermal units/pound, wherein the predetermined size comprises a length of approximately one and one-half inch, and wherein the non-conforming material is inert material; and further including cooling of the hydrogen-rich gas prior to liquefying.

These and other features, aspects and advantages of the present invention will become better understood with reference to the following drawings, description, and claims.

BRIEF DESCRIPTION OF THE DRAWINGS

The Sole FIGURE is a diagrammatical flow chart of an exemplary embodiment of the present invention.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

A general overview of the various features of the invention will be provided, with a detailed description following. Broadly, an embodiment of the present invention provides a method of producing a fully compliant, transportation-grade renewable ultra-low sulfur diesel (ULSD) to ASTM D975 and EN590 standards from renewable municipal solid waste (MSW) and tire waste feedstock/pellets. The conforming MSW and tire waste may comprise residential and commercial feedstock. By diverting MSW and tire waste from traditional MSW and tire waste landfilling operations, the result may be a significant reduction in net global carbon dioxide equivalent (CO2e) impact.

The present invention processes MSW and tire waste turning it into a high-energy solid fuel pellet/feedstock that is further processed into a fully compliant ULSD liquid transportation diesel without the use of a Fischer-Tropsch process and with a net reduction in global net CO2e impact.

In some embodiments of the present invention, a system utilizes inconsistent feedstock like MSW or tire waste that can vary by season, location, origin, the week, etc. The invention deselection waste fractions so that the remaining material meets the invention's processing parameters thus becomes a consistent, very-high-energy solid fuel. This solid fuel can be then converted into a renewable drop-in replacement for or blend stock to fossil USLD fuel which otherwise would be refined from fossil crude oil.

The MSW and tire waste feedstocks may be interchanged from various municipal and private sources.

In some embodiments of the present invention, the system may mitigate a need for MSW and tire waste to be landfilled or incinerated at a mass-burn plant, negatively impacting the environment by contaminating land, air, and water and negatively contributing to global CO2e impact.

In some embodiments of the present invention, the system generates renewable ULSD fuel (from a waste supply), is a full drop-in and/or blend replacement for fossil liquid diesel fuels derived from fossil crude oil. Unlike fossil fuels which are refined from a limited resource like fossil crude oil, this processing system utilizes renewable feedstock of MSW and tire waste, reducing its negative impact on our environment and turning it into an asset. Each gallon of renewable diesel that is produced may reduce society's need to drill for and refine ULSD from 3.5 gallons of fossil crude oil.

The processing system of the present invention relies on specific steps being executed in an order described below. At a sorting step, a waste feedstock is sorted, leaving only conforming waste capable of being converted into hydrogen-rich gas. The waste is then conditioned in a conditioning step into a specific recipe/ratio of moisture (<10%), cellulose (~95%) vs hydrocarbons (~5%), and sized "fluff"<1 cm). Upon testing and meeting a standard for elemental composition, the fluff is then pelletized to form a very compressed, high-BTU-rich (~1,100 BTU/lb), consistent solid fuel feedstock. The solid fuel pellets are then processed thermally in a high-temperature pyrolysis system which converts the solid fuel into a hydrogen-rich fuel gas. The fuel gas is reconstituted, converting it into a liquid ULSD fuel. The liquid fuel is then further analyzed and upgraded into fully compliant renewable diesel fuel and other valuable byproducts.

Each sub-system of the present invention has been designed, tested (by SGS and Intertek Labs), and has demonstrated its ability to process the MSW and tire waste and convert it into the asset of a fully compliant renewable diesel fuel, a replacement for and/or additive to fossil diesel. This process is a complex set of mechanical, thermal, and chemical systems and sub-systems that can sort, process, and measure the MSW and tire waste. It then can convert a solid engineered feedstock (pellets) into a fuel gas (similar to natural gas) and then convert that gas into a liquid fuel that is a replacement for liquid diesel fuel (which otherwise would have been derived from fossil crude oil). The resulting renewable ULSD fuel has been tested by two of the world's largest and most credentialled fuel testing laboratories as meeting all the requirements for an (US) ASTM D975 and (EU) EN590 diesel fuel.

The systems and sub-systems may be fabricated by the manufacturers, assembled, and commissioned by engineering, procurement, and construction contractors, and then put into production by operation and maintenance contractors.

This process may resolve the problem of MSW and tire waste disposal and renewable liquid diesel fuel production that challenges today's modern societies.

Additional byproducts may be produced by a biorefinery of the system in addition to the generation of renewable fuels including but not limited to agricultural-grade biochar, industrial grade graphene, and organic pesticides, agricultural-grade wood vinegar, waste recyclables and product reuse (metals, glass, etc.), agricultural-grade compost, and potable water.

Referring to the Sole FIGURE, the present invention may include method steps according to an embodiment of the present invention. Municipal Solid Waste (MSW) 10 enters a stream in a system. The MSW 10 (which often arrives in bags or bales) is opened and separated (wherein the continence is separated into like materials) 20.

The MSW 10 is then sorted 30. It may be sorted 30 to remove all inert and non-conforming waste products. Non-conforming material that does not meet the generally accepted definition includes white goods, e-Waste, C&D, industrial waste, medical waste, etc. human and animal waste, wastewater treatment sludge, etc. It may also be sorted 30 by using Artificial Intelligence (AI) optical, density, sizing, and mechanical processing systems to remove all non-conforming waste fractions. Recycled materials 32 may be removed at this stage.

The stream may be conditioned 40: Conforming waste (MSW from residents and commercial businesses) feedstock fractions may then be conditioned 40 by sizing 42 and drying 44. Sizing is the reduction of the size of the materials necessary in preparation to the palletization process. The conditioning 40 may also include milling and blending the waste to a specific set of feedstock standards (as described above). A homogeneous feedstock may be generated by a series of sub-system processes which custom blend, mill, and dry the waste fractions to a specific recipe (the operating parameters of the invention-moisture content [<10%], biogenic waste fractions [~95%] hydrocarbon waste fractions [~5%] metal and inert free, etc.). The conditioned waste may now largely be biogenic and waste hydrocarbons.

The stream may be pelletized 50: The conditioned waste may be processed into engineered high-BTU solid fuel pellets. The pellets may meet a specific size parameter (0.25"×1.5"+/−) resulting in a consistent and stable solid engineered feedstock to optimize the operating efficiency of the fuel conversion system. The feedstock pellets 54 may then be analyzed, in real-time, at a molecular level, to ensure conformance to the optimum feedstock design parameters of the plant's feedstock standards.

The engineered solid fuel pellets may then be processed using a high-temperature pyrolysis 60 system turning it into a hydrogen rich gas 64. Biochar/graphene 62 are produced as a byproduct of pyrolysis 60 and may be removed. The hydrogen rich gas 64 may then be cooled 66. Hot gasses 68 from pyrolysis 60 may be utilized for drying 44.

The now cooled hydrogen rich gas 64 is converted and may be reconstituted into a liquid USLD renewable diesel fuel 86 and other byproducts by oil and water separation 70. Unwasted moisture and solids may be removed. Wood vinegar 72 may be separated as a byproduct. Water 71 may be removed at this stage. The water 71 may be upgraded 74 and contaminants and sediment may be removed resulting in potable, reclaimed water 76.

Liquid ULSD 73 separated by the oil and water separation 70 may then be further processed by clarification/fuel upgrade 80, removing undesirable elements, leaving a fully compliant renewable transportation-grade diesel fuel 86 and other desirable byproducts, in other words a fuel upgrade. Contaminants and sediment 82 may be removed by clarification 80. The stream may be analyzed 84 for quality control after the clarification 80 to ensure that the prevailing industries' ASTM D975 and/or EN590 ULSD fuel parameters for transportation and power grade fuel are being met.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees.

Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. A method of producing diesel from municipal solid waste (MSW) without Fischer-Tropsch synthesis, the method comprising:

sorting a stream of inconsistent feedstock comprising non-conforming material and conforming material capable of being converted into a hydrogen-rich gas thereby, resulting in a conforming feedstock;

homogenizing the conforming feedstock of the inconsistent feedstock by way of blending, milling, and drying the conforming feedstock of the inconsistent feedstock until it consists of a fluff having a moisture content of no more than 10% by weight and a specific ratio of a biogenic waste fraction of approximately 95% by volume and a hydrocarbon waste fraction of approximately 5% by volume;

pelletizing the fluff to a plurality of pellets having a predetermined size;

gasifying the plurality of pellets into the hydrogen-rich gas; and liquifying the gas to diesel that is produced without Fischer-Tropsch synthesis, wherein the liquid diesel meets transportation-grade renewable ultra-low sulfur diesel according to ASTM D975 and EN590 standards.

2. The method of claim 1, wherein the hydrogen-rich gas has a gross heating value of approximately one thousand British thermal units/pound.

3. The method of claim 2, wherein the predetermined size comprises a length of approximately one and one-half inch.

4. The method of claim 3, wherein the non-conforming material comprises inert material.

5. The method of claim 4, further comprising cooling of the hydrogen-rich gas prior to liquefying.

6. The method of claim 5, wherein the inconsistent feedstock comprises tire waste.

7. The method of claim 1, wherein the sorting uses artificial intelligence optical system to deselect non-conforming material.

* * * * *